US005398583A

United States Patent [19]

Cook

[11] Patent Number: 5,398,583

[45] Date of Patent: Mar. 21, 1995

[54] SOUND DAMPING DEVICES TO IMPROVE THE RESONANCE OF THE SHELLS OF DRUMS

[76] Inventor: Lyndon M. Cook, 2484 Admore Dr., Valdese, N.C. 28690

[21] Appl. No.: 162,220

[22] Filed: Dec. 6, 1993

[51] Int. Cl.[6] ..... G10D 13/02

[52] U.S. Cl. ..... 84/411 M

[58] Field of Search ..... 84/411 M, 411 R, 412, 84/419, 420, 411 A; 181/207, 208

[56] References Cited

U.S. PATENT DOCUMENTS

| | | | |
|---|---|---|---|
| 635,192 | 10/1899 | Sapp | 84/413 |
| 4,325,281 | 4/1982 | Hardy | 84/411 M |
| 4,567,807 | 2/1986 | Robinson | 84/411 M |

*Primary Examiner*—Michael L. Gellner
*Assistant Examiner*—Cassandra C. Spyrou

[57] ABSTRACT

A new and improved sound damping device to improve the resonance of the shells of drums comprising, a drum shell formed of a rigid material in a cylindrical configuration, a drum head formed of a resonating member extending over the ends of the drum shell, a strip of foam material in a circular configuration, the cross section of the material including long parallel sides positionable in a vertical orientation and short parallel end edges extending cylindrically in a horizontal orientation, means to secure the material with the radially exterior long face in contact with the interior surface of the drum shell with the lower short edge of the material line in the plane of the lower circular edge of the drum shell in contact with the lower drum head.

2 Claims, 4 Drawing Sheets

FIG 3
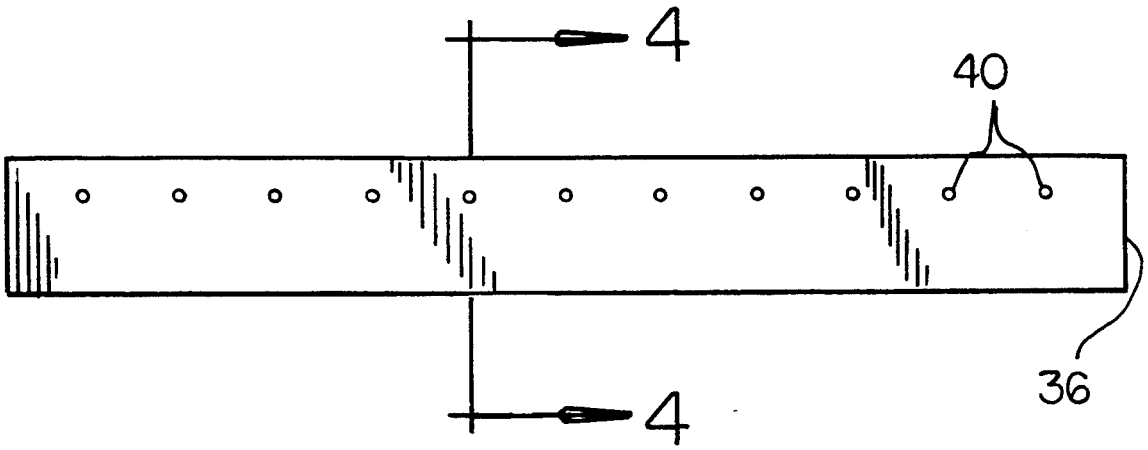
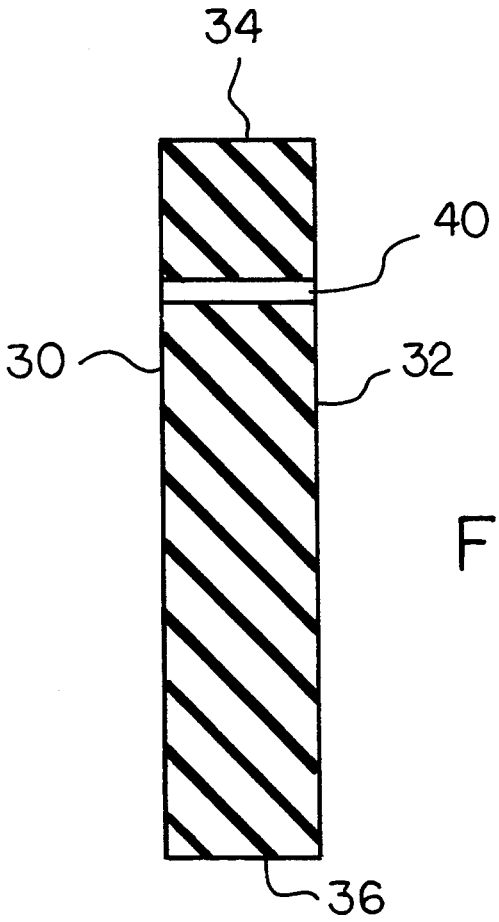
FIG 4

SOUND DAMPING DEVICES TO IMPROVE THE RESONANCE OF THE SHELLS OF DRUMS

BACKGROUND OF THE INVENTION

1. Field of the Invention

The present invention relates to sound damping devices to improve the resonance of the shells of drums and more particularly pertains to strips of resilient material in contact with the interior of a drum shell and a drum head to improve the sound characteristics of the drum.

2. Description of the Prior Art

The use of sound damping devices to improve the resonance of the shells of drums is known in the prior art. More specifically, sound damping devices heretofore devised and utilized for the purpose of improving the resonance of the shells of drums are known to consist basically of familiar, expected and obvious structural configurations, notwithstanding the myriad of designs encompassed by the crowded prior art which have been developed for the fulfillment of countless objectives and requirements.

The prior art discloses various types of drums systems, including damping devices. By way of example, U.S. Pat. No. 5,088,376 to Smith and 5,107,741 to Bealls disclose mufflers for bass drums.

U.S. Pat. No. 4,805,514 to Billings discloses a drum muffling, sound enhancing device for drums.

U.S. Pat. No. 5,159,139 to Beals discloses a drum head with overtone suppression capabilities.

Lastly, U.S. Pat. No. 4,589,323 to Belly discloses a drum muffler for use in association with a shell having two drum heads.

In this respect, the sound damping devices to improve the resonance of the shells of drums according to the present invention substantially depart from the conventional concepts and designs of the prior art, and in doing so provide an apparatus primarily developed for the purpose of providing a sound damping devices to improve the resonance of the shells of drums.

Therefore, it can be appreciated that there exists a continuing need for new and improved sound damping devices to improve the resonance of the shells of drums which can be used for improving sound. In this regard, the present invention substantially fulfills this need.

SUMMARY OF THE INVENTION

In view of the foregoing disadvantages inherent in the known types of sound damping devices to improve the resonance of the shells of drums now present in the prior art, the present invention provides improved sound damping devices to improve the resonance of the shells of drums. As such, the general purpose of the present invention, which will be described subsequently in greater detail, is to provide new and improved sound damping devices to improve the resonance of the shells of drums and method which has all the advantages of the prior art and none of the disadvantages.

To attain this, the present invention essentially comprises new and improved sound damping devices to improve the resonance of the drums, which have drum heads at both on the top and bottom of the shell, comprising, a drum shell formed of a rigid material in a cylindrical configuration and having a round top end and a round bottom end, a drum head formed of a resonating member extending over the top end and the bottom end of the drum shell, a plurality of tensioning members coupling the periphery of the upper drum head with the periphery of the lower drum head, a strip of foam material in a circular configuration, the cross section of the material including long parallel sides positionable in a vertical orientation and short parallel end edges extending cylindrically in a horizontal orientation, removable attachment means to secure the material with one radially exterior long face in contact with the interior surface of the drum shell with the lower short edge of the material line in the plane of the lower circular edge of the drum shell in contact with the lower drum head, the material being formed of two separate semicircular halves in edge to edge contact to form an entire cylinder, a hole extending through the entire material along its length and a resilient rod positioned therein and a cavity formed within the resilient rod, the resilient rod having a closed end and an open end with threads located at its open end, a cap releasably secured over the open end and a fluid contained within the cavity.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved sound damping devices to improve the resonance of the shells of drums which have all the advantages of the prior art of sound damping devices to improve the resonance of the shells of drums and none of the disadvantages.

It is another object of the present invention to provide new and improved sound damping devices to improve the resonance of the shells of drums which may be easily and efficiently manufactured and marketed.

It is further object of the present invention to provide new and improved sound damping devices to improve the resonance of the shells of drums which are of durable and reliable constructions.

An even further object of the present invention is to provide new and improved sound damping devices to improve the resonance of the shells of drums which are susceptible of a low cost of manufacture with regard to both materials and labor, and which accordingly are then susceptible of low prices of sale to the consuming public, thereby making such sound damping devices to improve the resonance of the shells of drums economically available to the buying public.

Still yet another object of the present invention is to provide new and improved sound damping devices to improve the resonance of the shells of drums which provide in the apparatuses and methods of the prior art some of the advantages thereof, while simultaneously overcoming some of the disadvantages normally associated therewith.

Even still another object of the present invention is to improve the resonance of the shells of drums through sound damping.

Lastly, it is an object of the present invention to provide sound damping devices to improve the resonance of the drums, which have drum heads at both on the top and bottom of the shell comprising a drum shell formed of a rigid material in a cylindrical configuration, a drum head formed of a resonating member extending over the ends of the drum shell, a strip of foam material in a circular configuration, the cross section of the material including long parallel sides positionable in a vertical orientation and short parallel end edges extending cylindrically in a horizontal orientation, means to secure the material with the radially exterior long face in contact with the interior surface of the drum shell with the lower short edge of the material line in the plane of the lower circular edge of the drum shell in contact with the lower drum head.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a plane view of the damping device illustrated in FIG. 2.

FIG. 4 is a sectional view of the damping device taken along line 4—4 FIG. 3.

The same reference numerals refer to the same parts through the various Figures.

DESCRIPTION OF THE PREFERRED EMBODIMENT

Figure 1:
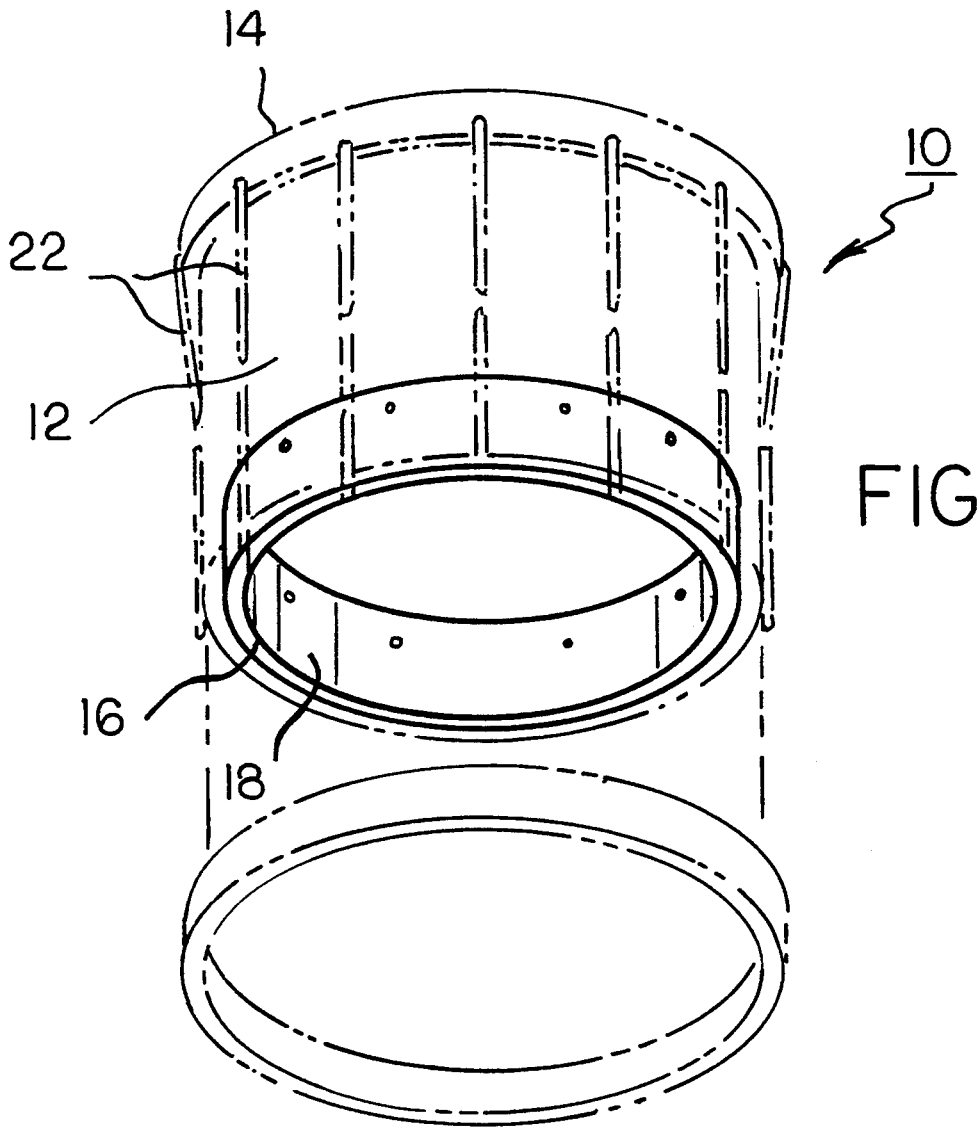
FIG. 1 is an exploded perspective view of a sound damping device to improve the resonance of the shells of drums constructed in accordance with the principals of the present invention.
Figure 2:
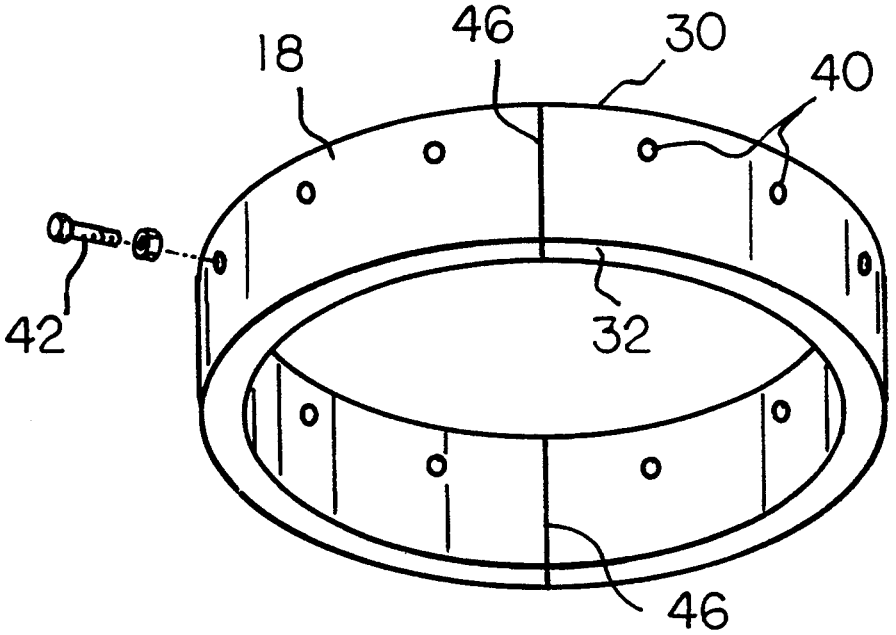
FIG. 2 is a perspective view of the damping device as employed in the drum system of FIG. 1.
Figure 5:
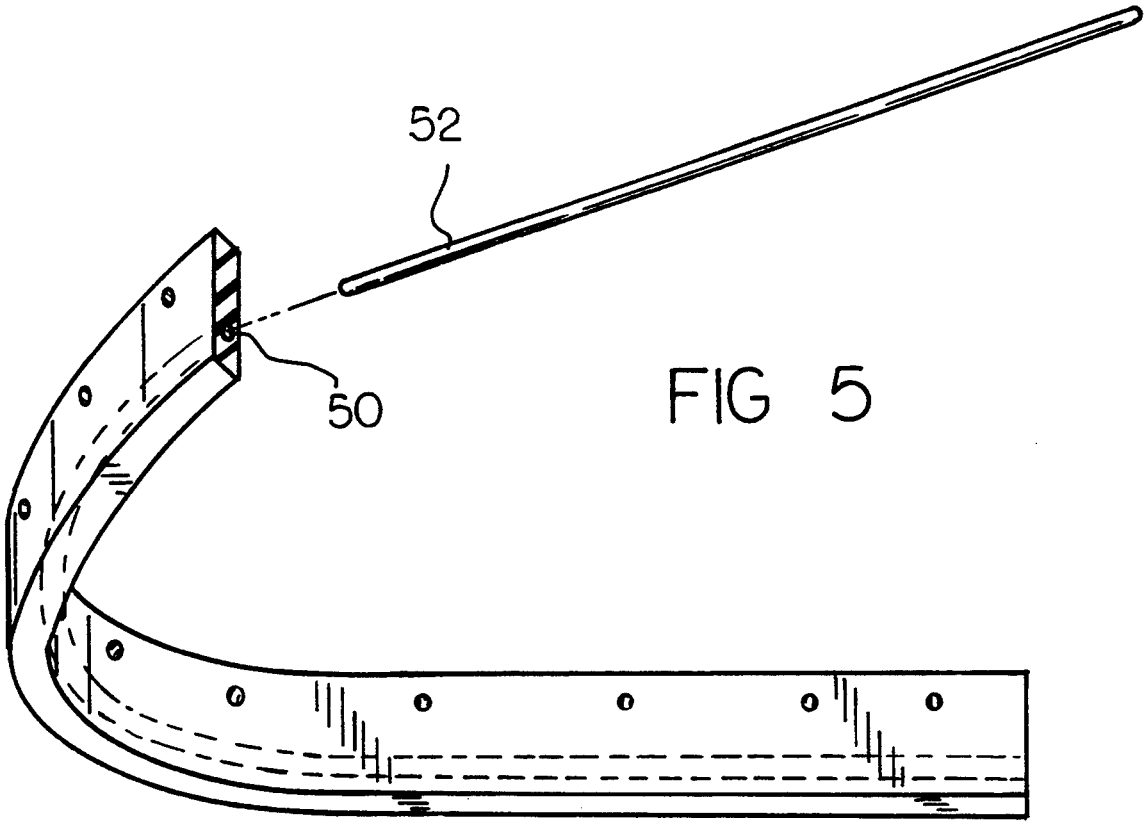
FIG. 5 is a damping device constructed in accordance with an alternate embodiment of the invention.
Figure 6:
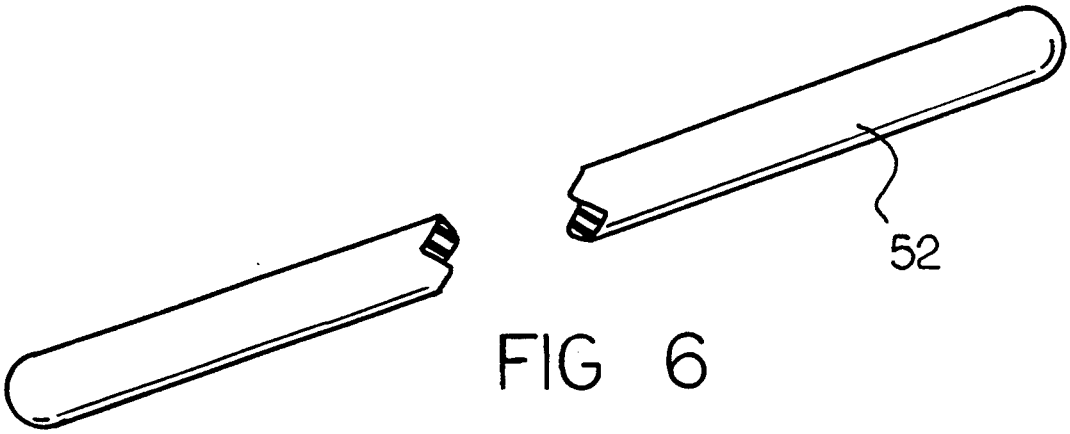
FIG. 6 is a enlarged perspective view of a portion of the rod employed in the FIG. 5 embodiment.
Figure 7:
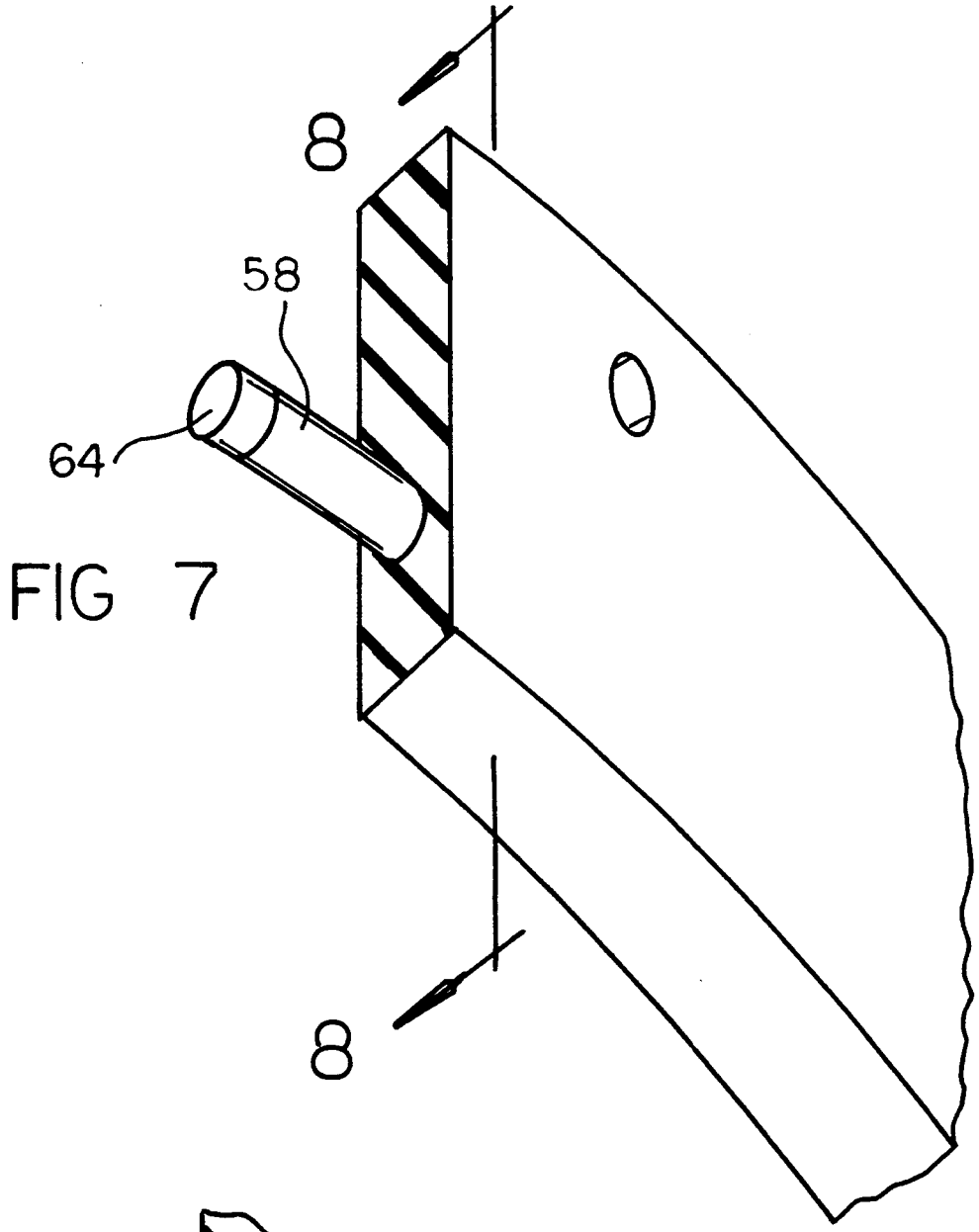
FIG. 7 is a perspective view illustrating another alternate embodiment of the invention.
Figure 8:
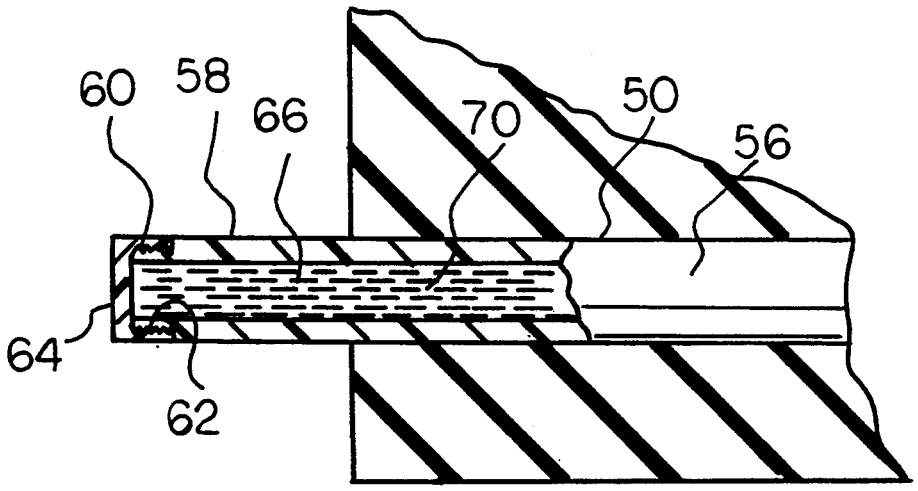
FIG. 8 is a sectional view of the damping device of FIG. 7 taken along line 8—8 of FIG. 7.

With reference now to the drawings, and in particular to FIG. 1 thereof, the preferred embodiment of the new and improved sound damping device to improve the resonance of the shells of drums embodying the principles and concepts of the present invention and generally designated by the reference numeral 10 will be described.

The new and improved sound damping devices of the present invention function to improve the resonance of the drums. Such devices are particularly applicable to drums of the type having drum heads at the top and at the bottom of the shell. As can best be understood by reference to FIGS. 1 through 4, the invention is in a system 10 having a drum shell 12, drum heads 14 and 16 and the damping device 18.

The drum shell 12 is formed of a rigid material in a cylindrical configuration. Such shell has a round top end and a round bottom end.

Located over the top and bottom ends of the drum shell 12 are drum heads 14 and 16. Each drum head is formed of a resonating member extending tightly in position to cover the top end and the bottom end of the drum shell.

A plurality of tensioning members 22 couple the periphery of the upper drum head 14 with the periphery of the lower drum head 16. A strip of foam material 18, the damping device, is then provided. It is fabricated as an elongated member positionable in a circular configuration. The cross section of the material includes long parallel sides 30 and 32 positionable in a vertical orientation and short end edges 34 and 36 extending cylindrically in a horizontal orientation.

Apertures 40 are formed through the material with removable attachment means 42, preferably nuts and bolts, extending therethrough to secure the material to the drum shell. This is done with the radially exterior long face 32 of the material in contact with the interior surface of the drum shell 12 at its bottom. In addition, the lower short edge 36 of the material is positioned in the plane of the lower circular edge of the drum shell in contact with the lower drum head 18.

The material is preferably formed of two separate semicircular halves in edge to edge contact to form an entire cylinder. Note the two dividing lines 46 of FIG. 2.

In an alternate embodiment of the invention, a hole 50 extends through the entire material along its length. A resilient rod 52 is preferably positioned in the hole.

In another alternate embodiment of the invention, an elongated circular cavity 50 is formed to hold a resilient rod 56. The resilient rod has a closed end, not shown, and an open end 58. Threads 60 are located at its open end. A cap 64 with threads 66, mateable with threads 62, is releasably secured over the open end 58 and a fluid 70 contained within the cavity.

Sound damping devices to improve the resonance of the shells of drums improve the resonance of the shells of drums which have drum heads at both the top and bottom. They serve to equalize the pressure on the drum shell so that the entire circumference resonates cleanly, without any stray harmonics. The improvement which results from the addition of sound damping devices to improve the resonance of the shells of drums is very apparent, even to an untrained ear, and to a trained person, the change is spectacular. The change can be attributed to the physical nature of the foam material. There are other damping devices on the market, but they do not approach the effectiveness of this device. The sound damping device is very resilient and virtually bounces with the vibrations, while the other materials are relatively dull. Resonance is the true source for better drum sound, so this feature is vital in manufacturing drums which are superior.

The sound damping devices are placed in contact with the bottom drumhead and fastened in place with screws, so they always remain in place, regardless of how many times the drum heads are replaced. Other devices re usually attached with adhesives, so they are subject to becoming dislodged or shifting.

Some of the advantages of sound damping devices to improve the resonance of the shells of drums are the ease of attachment, the half shell coverage, and the ability to supply them in almost any color. There is also relatively little difference in cost between these superior dampers, and the units which are now being sold. The units, however, will last more than a lifetime and will be trouble free.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. In combination with a drum, a sound damping device to improve the resonance of the drum, comprising:

a drum shell formed of a rigid material in a cylindrical configuration with a vertical axis and having a round top end and a round bottom end;

a drum head formed of a resonating member extending over one end of the drum shell;

a strip of foam material in a cylindrical configuration, the cross section of the material including long parallel sides positionable in a vertical orientation with one of the long sides positionable in contact with the drum shell and short parallel ends in a horizontal orientation, the short end including a first end and a second with the first end positionable in contact with the drum head; and removable attachment means to secure the material with the one of said long sides in contact with the drum shell and with the first end in contact with the drum head, the attachment means including holes extending through the sides in a line parallel with the first end adjacent thereto, the holes being sized for the receipt of removable fasteners for coupling to the drum shell.

2. The combination as set forth in claim 1 and further including a hole extending entirely through the material along the length of the strip, parallel with the second end, and adjacent thereto and a resilient rod positioned therein.

* * * * *